United States Patent [19]

Drumm

[11] Patent Number: 4,490,877

[45] Date of Patent: Jan. 1, 1985

[54] SPIRAL BRUSH SECTION

[76] Inventor: Arthur E. Drumm, 20042 State, Rte. #4, Marysville, Ohio 43040

[21] Appl. No.: 556,274

[22] Filed: Nov. 30, 1983

[51] Int. Cl.[3] ..... A46B 7/10

[52] U.S. Cl. ..... 15/182; 300/21

[58] Field of Search ..... 15/179, 181, 182, 183, 15/79 R, 79 A; 300/2, 21

[56] References Cited

U.S. PATENT DOCUMENTS

| | | | |
|---|---|---|---|
| 2,734,210 | 2/1956 | Crevier | 15/182 |
| 2,757,401 | 8/1956 | Peterson | 15/182 |
| 2,941,223 | 6/1960 | Klauer | 15/79 |
| 3,107,382 | 10/1963 | Tilgner | 15/182 |
| 3,357,562 | 12/1967 | Sherman, Jr. | 210/196 |
| 3,688,335 | 9/1972 | Clark | 15/182 |
| 3,812,551 | 5/1974 | Mortensen | 15/179 |
| 3,900,915 | 8/1975 | Rosseau | 15/182 |
| 4,267,616 | 5/1981 | Hunt | 15/182 |

*Primary Examiner*—Peter Feldman

*Attorney, Agent, or Firm*—William V. Miller

[57] ABSTRACT

A helical brush section consisting of a split tubular support which is offset at the split longitudinally to provide helical edges terminating in longitudinally extending contact shoulders at its opposed ends. This section has a bristle-carrying strip helically wound thereon. Multiples of this section are adapted to be disposed on a mandrel with their adjacent edges and shoulders in interfitting nesting engagement to form a continuous helical rotary brush.

9 Claims, 6 Drawing Figures

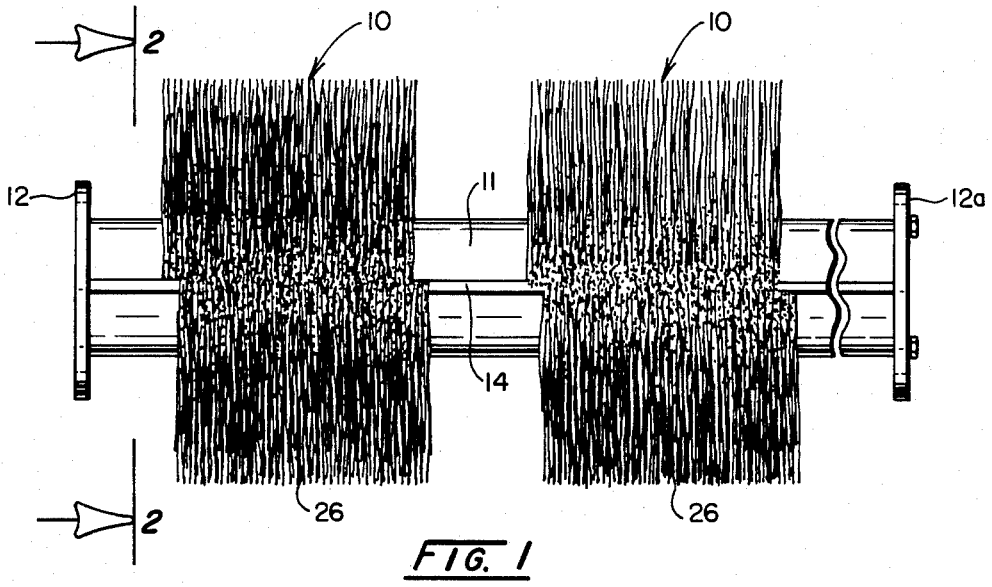
FIG. 1
FIG. 2
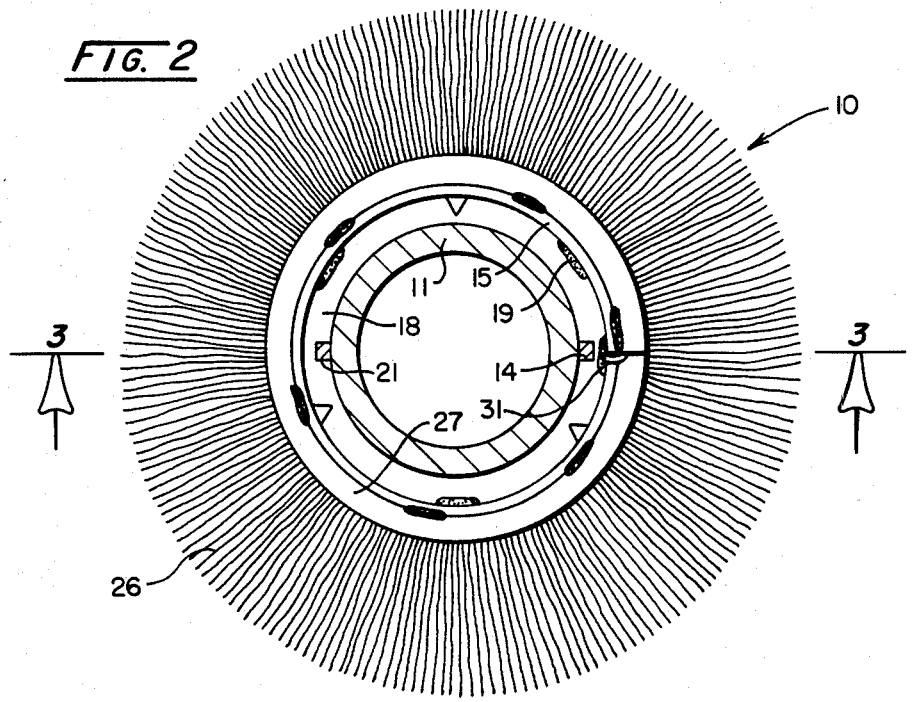

SPIRAL BRUSH SECTION

BACKGROUND OF THE INVENTION AND PRIOR ART

This invention relates to a spiral or helical brush section adapted to be used in multiples of axially-interfitting or nesting sections to complete a rotary brush of desired length. Continuous spiral brushes are now commonly made in the form of a one-piece elongated drum having the brush bristles mounted thereon as a continuous helix or spiral extending from one end of the mandrel to the other. This type of brush is ordinarily employed in removal from and replacement on a drive mandrel because of its weight due to the one-piece drum construction. Attempts have been made in the prior art to overcome this by making the brush in short spiral sections, but the arrangements provided leave large gaps in the spiral where the sections abut. Another arrangement in an attempt to overcome this is the use of rings or wafers of bristles mounted on the mandrel but this is not a spiral which is desirable.

SUMMARY OF THE INVENTION

According to this invention the rotary brush is to be made up of a plurality of axially-aligned interfitting or nesting helical brush sections to obtain a brush of desired length. Each section, according to this invention, is made of a relatively short split tube section which has its ends offset at its joint to form contact shoulders so that the shouldered end of one section will interfit with and engage the shouldered end of the adjacent section when slipped axially on the mandrel. Each section will have a brush strip helically wound thereon which consists of a channel having U-shaped bristles disposed thereon. The bristles are retained in the channel by means including a retaining wire which may be used as an aid in locking the channel to the offset end of the tube.

BRIEF DESCRIPTION OF THE DRAWINGS

The best mode contemplated in carrying out this invention is illustrated in the accompanying drawings in which:

FIG. 1 is a side view showing a pair of brush sections made according to this invention being slipped over the mandrel;

FIG. 2 is an enlarged transverse section taken along line 2—2 of FIG. 1;

With specific reference to the drawings, the spiral or helical brush sections of this invention are indicated generally by the numeral 10. In FIG. 1, two of these sections are shown being slipped on a hollow tubular mandrel 11 of a common type which has a fixed stop collar 12 at one end and a removable one 12*a* at the other end. The mandrel 11 may have keys or splines 14 extending its length. Ordinarily in the prior art an elongated heavy brush section is mounted on and driven by the mandrel but, according to this invention, the rotary brush is made up of a plurality of short axial sections 10 having their adjacent ends interengaging and interfitting so that they can be effectively driven as a single unit.

As shown in FIG. 4 each section 10 is made of a sheet metal drum 15 formed from a rolled tube section which is split longitudinally at a joint 16. The joint is fastened together, such as by welds 17, but the ends of the sheet are offset before welding to form shoulders 21 and 22 at opposite ends of the tube or drum 15. Thus, each end of the drum 15 has a helically-extending edge 21*a* or 22*a* terminating in a longitudinally extending shoulder 21 or 22. Shoulders 21 and 22 will be in engagement in either direction of rotation of the completed rotary brush assembly as will later appear. Within the drum 15 towards its opposed ends driving collars 18 have their peripheral edges welded to the inner surface of the drum by welds 19. These collars on their inner edges have keyways 21 for receiving the mandrel splines 14.

Figure 5:
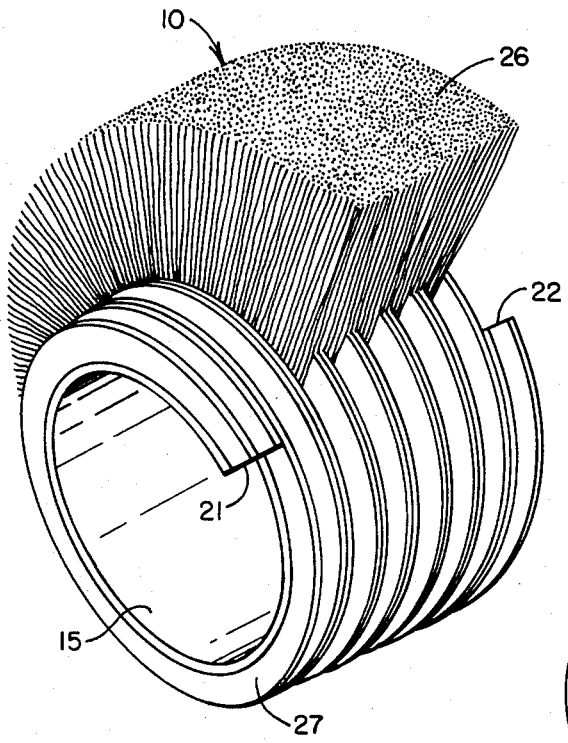
FIG. 5 is a perspective view of the brush section with bristles removed from the mounting channel for purpose of illustration.
Figure 5A:
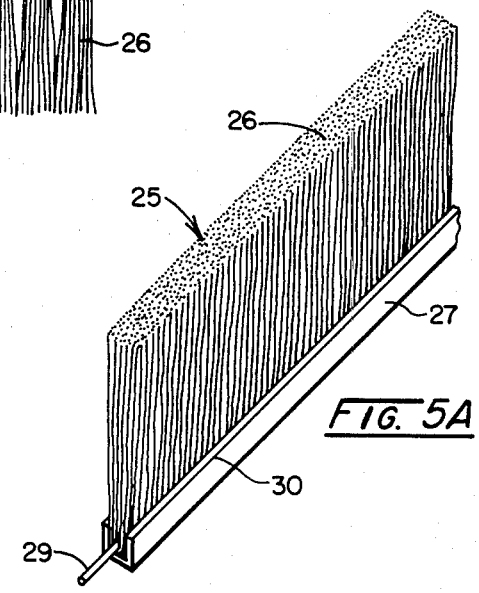
FIG. 5A is a perspective view of a bristle-carrying strip to be mounted on the drum.
Figure 4:
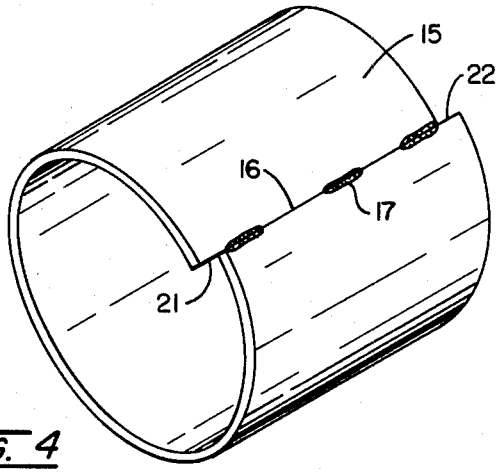
FIG. 4 is a perspective view of the support tube or drum used in making the brush sections.

The brush strip used in forming the helical brush section according to this invention is initially in the form of a straight strip shown in FIG. 5A and is indicated generally at 25. It comprises a metal channel 27 which has the bristles 26 of U-form with their closed ends dispersed in the elongated metal channel. Extending through the U-shaped ends of the bristles is a retaining wire 28 and it will be noted that it projects beyond the adjacent ends of the channel at 29. The sides of the channel are crimped at 30, outwardly of the wire 28. Thus, the bristles will be retained as a continuous row in the channel.

Figure 3:
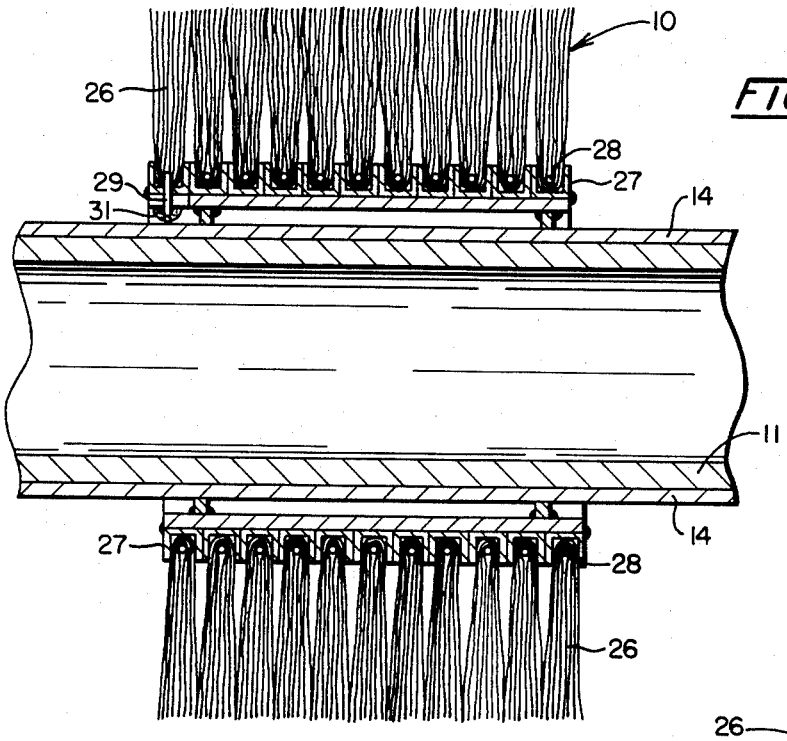
FIG. 3 is an axial section taken along line 3—3 of FIG. 2.

This straight brush strip is wound helically around the offset drum 15 in convolutions as shown in FIG. 5 from one shoulder 21–22 to the other and is secured to the drum by welding its ends to the drum and also preferably welding the projecting end 29 of the wire on the adjacent shoulder 21 or 22, as indicated at 31 in FIGS. 2 and 3. The result is the continuous helical brush section 10 shown in the drawings. It is shown with tight convolutions but the helix may have any desired pitch.

As indicated, multiples of this brush section 10 are used in nesting relationship to form the complete rotary brush with a continuous helix without gaps. To form the brush, the sections 10 are slipped axially onto the mandrel 11 from the end where the collar 12*a* is removed. When this collar is later replaced the sections 10 will be clamped axially against the stop collar 12. At this time the ends of adjacent sections will interfit and interengage at the shoulders 21–22 so that the sections will function as a simple continous helical rotary brush with no bristle gap. The drive from the mandrel 11 will be through splines 14 and collars 18. Relative rotative movement of the sections 10 is also resisted by the contact of shoulders 21–22.

It will be apparent that the above invention provides for short simple helical brush sections which are easy to handle and assemble in nesting relationship as a continuous helical rotary brush. The sections are made to interfit without expensive matching. When mounted, which is a simple operation, they interfit and interengage so that they can be rotated to function efficiently as a simple continuous rotary drum helical brush.

Having thus described the invention, what is claimed is:

1. A helical brush section for use in axially-aligned relationship to form a rotary brush comprising a tubular bristle-carrying support, said support having helically extending edges at its opposed ends terminating in longitudinally extending contact shoulders for engaging adjacent similar sections, said tubular support being rolled sheet metal joined at a longitudinal joint where the adjacent edges of the sheet are offset longitudinally to form the opposed end helical edges and contact shoulders.

2. A helical brush section according to claim 1 in which a bristle-carrying brush strip is wound helically about the tubular support in convolutions of selected pitch from one contact shoulder to the other and is secured thereto at its ends.

3. A helical brush section according to claim 2 in which the bristle-carrying strip is in the form of a channel having bristles of U-form mounted therein with their closed ends in the channel, and a retaining wire extends through such ends and beyond the adjacent ends of the channel with such ends secured to said tubular support.

4. An assembly of helical brush sections of the structure defined in claim 2 disposed on a mandrel in axial contact with their adjacent ends interfitting.

5. An assembly according to claim 4 including means for clamping the sections in axial contact on the mandrel.

6. The method of forming a helical brush section which comprises forming a tubular support by offsetting the adjacent edges of a longitudinally-split tube at the split thereof to form opposed helical edges at its ends terminating in contacting shoulders, and mounting thereon a helically-extending bristle-carrying strip.

7. The method of claim 6 in which the strip is formed as a channel with radially-projecting bristles, and winding the strip on the tubular support helically from one shoulder to the other where it is attached to the support.

8. The method of claim 7 in which the strip has U-shaped bristles held in the channel by means including a retaining wire having ends extending beyond the channel, and welding the channel to the support.

9. The method of claim 8 including welding the extending ends of the wire to the support at said shoulders.

* * * * *